US008201384B2

(12) United States Patent
Krestel

(10) Patent No.: US 8,201,384 B2
(45) Date of Patent: Jun. 19, 2012

(54) GIRDER-LIKE STRUCTURAL ELEMENT COMPOSED OF INDIVIDUAL PARTS CONNECTED TO ONE ANOTHER

(76) Inventor: Stefan Krestel, Graz (AT)

( * ) Notice: Subject to any disclaimer, the term of this patent is extended or adjusted under 35 U.S.C. 154(b) by 296 days.

(21) Appl. No.: 12/096,282

(22) PCT Filed: Nov. 23, 2006

(86) PCT No.: PCT/AT2006/000481

§ 371 (c)(1),
(2), (4) Date: Jun. 5, 2008

(87) PCT Pub. No.: WO2007/065182

PCT Pub. Date: Jun. 14, 2007

(65) Prior Publication Data

US 2009/0013628 A1 Jan. 15, 2009

(30) Foreign Application Priority Data

Dec. 7, 2005 (AT) ..... A 1961/2005

(51) Int. Cl.
*E04C 3/00* (2006.01)

(52) U.S. Cl. ..... 52/840; 52/837; 52/838; 52/635; 52/696; 52/836

(58) Field of Classification Search ..... 52/635, 52/642, 690, 693, 694, 696, 837, 838, 840, 52/842, 836

See application file for complete search history.

(56) References Cited

U.S. PATENT DOCUMENTS 1,542,507 A * 6/1925 Wilson ..... 52/690
1,598,129 A * 8/1926 Gersman ..... 52/635
1,733,778 A * 10/1929 Connell ..... 52/635
2,142,637 A * 1/1939 Faber ..... 52/635
2,154,944 A 4/1939 Kullmer
2,157,233 A * 5/1939 Geib, Jr. ..... 52/842
2,220,596 A * 11/1940 Bernhardt ..... 428/186
2,796,921 A * 6/1957 Neely ..... 52/693
3,111,204 A * 11/1963 Phare ..... 52/635
3,245,186 A * 4/1966 Jentoft ..... 52/334
3,256,670 A * 6/1966 Tersigni ..... 52/634
3,349,535 A * 10/1967 Balinski ..... 52/634

(Continued)

FOREIGN PATENT DOCUMENTS

AT 285129 10/1970

(Continued)

*Primary Examiner* — Robert Canfield

*Assistant Examiner* — Matthew Gitlin

(74) *Attorney, Agent, or Firm* — Dickstein Shapiro LLP

(57) ABSTRACT

A beam-like structural component (2) made up of individual parts connected to each other, comprising at least one flange (9) and at least one web (1), which structural component is easy to produce and exhibits high load-bearing capacity and torsional rigidity, is characterized in that the web (1) is formed by web members (6) extending transversely to the longitudinal extension of the web (1), with web members (6) forming a linear longitudinal area (4, 5) extending across the length of the web (1) and with, in each case, two adjacent web members (6) extending toward different narrow edges (7, 8) of the flange (9) starting from the longitudinal area (4, 5) of the web (1) so that one web member (6) rests against the flange (9) with one side of the web (1) and the adjacent web member (6) rests against the flange (9) with the opposite side of the web (1) and the web members (6) exhibit the shape of an "S" (FIG. 1E).

23 Claims, 14 Drawing Sheets

U.S. PATENT DOCUMENTS

| | | | | | |
|---|---|---|---|---|---|
| 3,376,684 | A | * | 4/1968 | Cole et al. | 52/635 |
| 3,461,636 | A | * | 8/1969 | Hern | 52/650.1 |
| 3,737,964 | A | * | 6/1973 | Jury | 29/897.31 |
| 3,945,168 | A | * | 3/1976 | Butts et al. | 248/351 |
| 4,004,334 | A | * | 1/1977 | Greenley | 29/897 |
| 4,160,350 | A | * | 7/1979 | Craib | 52/696 |
| 4,228,631 | A | * | 10/1980 | Geffe | 52/690 |
| 4,291,515 | A | * | 9/1981 | Harding | 52/694 |
| D265,688 | S | * | 8/1982 | Bissu | D25/132 |
| 4,442,650 | A | * | 4/1984 | Sivachenko | 52/694 |
| 4,475,328 | A | * | 10/1984 | Reeder et al. | 52/693 |
| 4,490,958 | A | * | 1/1985 | Lowe | 52/634 |
| 4,501,102 | A | * | 2/1985 | Knowles | 52/690 |
| 4,506,487 | A | * | 3/1985 | Hill | 52/690 |
| 4,523,419 | A | * | 6/1985 | Palacio et al. | 52/690 |
| 4,726,166 | A | * | 2/1988 | DeRees | 52/694 |
| 4,819,400 | A | * | 4/1989 | Kindberg | 52/693 |
| 4,885,892 | A | * | 12/1989 | Gooding | 52/690 |
| 4,947,612 | A | * | 8/1990 | Taylor et al. | 52/693 |
| 5,301,486 | A | * | 4/1994 | Taylor | 52/695 |
| 5,519,978 | A | * | 5/1996 | Sucato et al. | 52/481.1 |
| 5,524,410 | A | * | 6/1996 | Menchetti | 52/838 |
| 5,551,135 | A | * | 9/1996 | Powers, III | 29/6.1 |
| 5,588,273 | A | * | 12/1996 | Csagoly | 52/634 |
| 5,617,693 | A | * | 4/1997 | Hefner | 52/693 |
| 5,653,079 | A | * | 8/1997 | Loeffler et al. | 52/712 |
| 5,685,124 | A | | 11/1997 | Jandl, Jr. et al. | |
| 6,212,846 | B1 | * | 4/2001 | Johnston | 52/648.1 |
| 6,416,114 | B1 | * | 7/2002 | Topker et al. | 296/146.6 |
| 6,497,080 | B1 | * | 12/2002 | Malcolm | 52/846 |
| 6,701,688 | B2 | * | 3/2004 | Matiere | 52/649.2 |
| 6,976,343 | B2 | * | 12/2005 | McGushion | 52/840 |
| 2002/0148189 | A1 | * | 10/2002 | Steadman | 52/690 |
| 2002/0148193 | A1 | * | 10/2002 | Veilleux et al. | 52/729.4 |
| 2008/0148657 | A1 | * | 6/2008 | Krestel | 52/223.8 |

FOREIGN PATENT DOCUMENTS

| | | |
|---|---|---|
| GB | 560913 | 4/1944 |
| WO | WO 2006/079134 | 8/2006 |

* cited by examiner 1
1''
12
1
6
4
13
13
5
6
1
6
5
1
6
8
5
10'
7
9
2

4
5
1"
6
1
9
10'
2

1'
1
4
5
6
9
2

1'
1
5
6
9
2

6
1
1"
12
5
9
2

1'
6
9
2

1'
2
4
5
6
7
8
9
18

1'
4
5
6
18
9
2

GIRDER-LIKE STRUCTURAL ELEMENT COMPOSED OF INDIVIDUAL PARTS CONNECTED TO ONE ANOTHER

The invention relates to a beam-like structural component made up of individual parts connected to each other, comprising at least one flange and at least one web.

It is known to manufacture a structural component having one flange and two webs, with the two webs forming a triangle together with the flange, as an extruded profile.

From GB 560 913 A, a plate-shaped supporting member is known which is formed by an upper plate and a lower plate, between which a structural component having a meander-shaped cross-section is inserted which is connected both to the upper plate and to the lower plate.

AT 285 129 B relates to a wall element comprising a number of boards assembled in a zigzag-shaped manner and connected to each other at their ends, with projecting grooves being provided at the two longitudinal edges of each board, whereby the boards can be connected to form a continuous component part inserted between an upper plate and a lower plate.

Furthermore, it is known to insert honeycombed structures between two flat plates, wherein the honeycombs are formed by honeycombs extending vertically to the two plates.

It is the object of the invention to provide a structural component of the initially described kind which is manufacturable in a particularly simple manner and exhibits not only a high load-bearing capacity but also a very high torsional rigidity. Furthermore, it should be possible to form plate-shaped supporting members with such a structural component.

According to the invention, said object is achieved in that the web is formed by web members extending transversely to the longitudinal extension of the web, with web members forming a linear longitudinal area extending across the length of the web and with, in each case, two adjacent web members extending toward different narrow edges of the flange starting from the longitudinal area of the web so that one web member rests against the flange with one side of the web and the adjacent web member rests against the flange with the opposite side of the web and the web members exhibit the shape of an "S".

A simple basic shape of the structural component is characterized in that web members form with one end a linear longitudinal edge extending across the length of the web, from which longitudinal edge adjacent web members extend toward different narrow edge regions of the flange.

Simple manufacture of a web can be effected if the web is formed by integrally connected web members, wherein, in each case, two adjacent web members are integrally connected to each other on at least one longitudinal area, in particular on one of the longitudinal edges.

Rationalization of the assembly can be achieved if the ends of the web members project into a notch of the flange and are connected there to the flange, whereby also a smooth web surface is achievable in this manner.

The last described embodiment is preferably developed further in that the notch exhibits an extension which is transverse to the longitudinal edge of the web members and is of a size that equals half the thickness of the web members at the longitudinal edge thereof.

For particularly stable structural components it is advantageous if the web members are arranged directly adjacent to each other and are separated from each other by a maximum distance on the order of the width of a saw kerf.

If webs are produced from plates by punching, material saving can be achieved in that adjacent web members are provided at a distance corresponding to at least the width of a web member.

An optically perfect construction is achievable if the ends of the web which extend along the longitudinal sidewall of the flange terminate flush with at least a portion of the outside of the flange, preferably as a result of machining which preferably is performed on a supporting member made up of several structural components.

In order to achieve a particularly high load-bearing capacity with, at the same time, excellent torsional rigidity, the ratio of the width of a flange to the height of the web ranges between 1:20 and 1:1, preferably from 1:6 to 1:1, in particular from 1:3.5 to 1:2.5.

The structural component is preferably characterized in that it is formed from wood, with the flange preferably being manufactured from sawn timber and the web preferably being manufactured from plywood, the web suitably being formed from a plywood having at least three layers of wood with the wood fibres of the outside of the plywood extending in the longitudinal direction of the structural component. Constructions of this kind provide a particularly good ratio between the dead weight and the load-bearing strength. In addition, low-grade sawn timber from the sawmill industry can be used for the flange, resulting in an increase in the added value of said timber.

An adhesive material, in particular glue, preferably synthetic resin glue or PU-glue, is suitably used for connecting the individual parts.

Suitably, the cavity defined by the web and the flange is filled with a material such as silica sand, cellulose flakes, pearlites, PU-foam, etc. This filling leads to solutions for all kinds of problems, such as, e.g., for satisfying thermic and acoustic demands. As desired, the filling can occur prior to or after the installation of a structural component, the latter involving the advantage of easier manipulation, particularly since in that case only the lightweight hollow structural components have to be transported.

According to a preferred embodiment, the web members extend beyond the flange on both sides thereof and are interconnected on both ends with a double-S and a linear longitudinal edge being formed, whereby load-bearing capacity and also torsional rigidity may be increased even further.

Preferably, the longitudinal edges of the web which project beyond the flange are formed integrally.

Thereby, the flange is furthermore suitably arranged on a central plane of symmetry of the structural component.

Preferably, a further flange is provided on at least one longitudinal edge of the web, whereby the structural component is provided with two flanges arranged spaced apart from each other for the dissipation of power.

A preferred variant is characterized in that adjacent web members are formed by cutting into a plate alternately, namely once from a longitudinal edge region and once from the opposite longitudinal edge region, wherein the end regions of the web members, which project beyond the flange, are in each case connected to each other by means of a further flange.

A further preferred variant is characterized in that the web members are designed so as to be integrally connected in a preferably central area located between their ends with regard to their lengths and that the parts of the web members which extend away from said area toward one side and toward the other side in each case extend toward a flange in a manner bent in the same direction or in an opposite direction.

The structural components according to the invention can be excellently used for the formation of a planar-shaped supporting member, wherein the structural components are arranged next to each other and are connected to each other, preferably stuck together, with the flanges being arranged in one plane.

According to a preferred embodiment, flanges lying on one surface, in particular one plane, are formed integrally with a plate being formed, wherein the end regions of the web members are inserted into grooves incorporated in the plate.

Below, the invention is illustrated in further detail based on numerous embodiments, wherein FIG. 1D illustrates a first variant and FIGS. 1A to 1E show the process of manufacture of such a structural component, in each case in an oblique view.

FIGS. 8A to 8D again show a further embodiment in an illustration analogous to FIGS. 1A-D. The same applies to FIGS. 9A to D, 10A to D, 11A to D, 12A to D and 13A to D, respectively.

Figure 16:
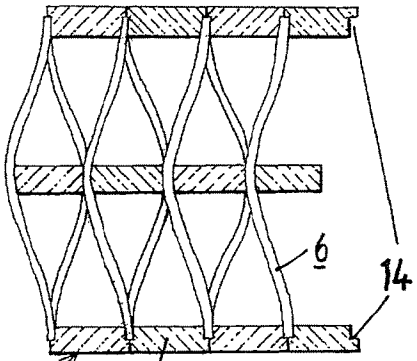
Figure 14:
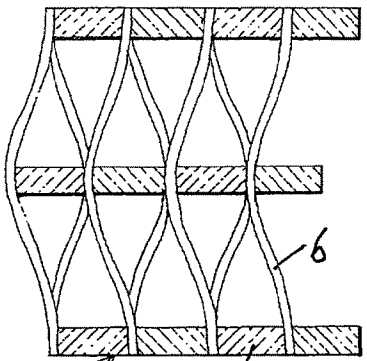
Figure 17:
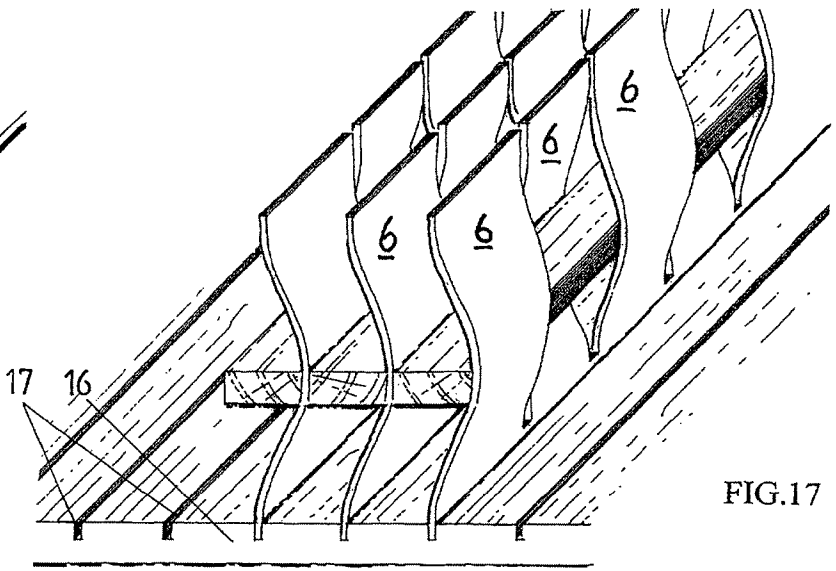
Figure 15:
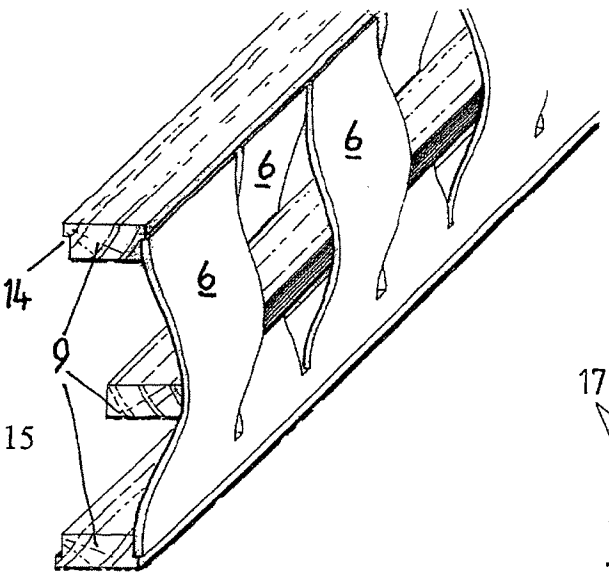

FIGS. 14, 16 and 18 again concern cross-sectional views, wherein FIG. 15 depicts a partial view of FIG. 16 and FIG. 17 depicts a partial view of FIG. 18, in each case in an oblique view.

FIGS. 19A-D and 20A-D show variants in an illustration analogous to FIGS. 1A-D.

Figure 21:
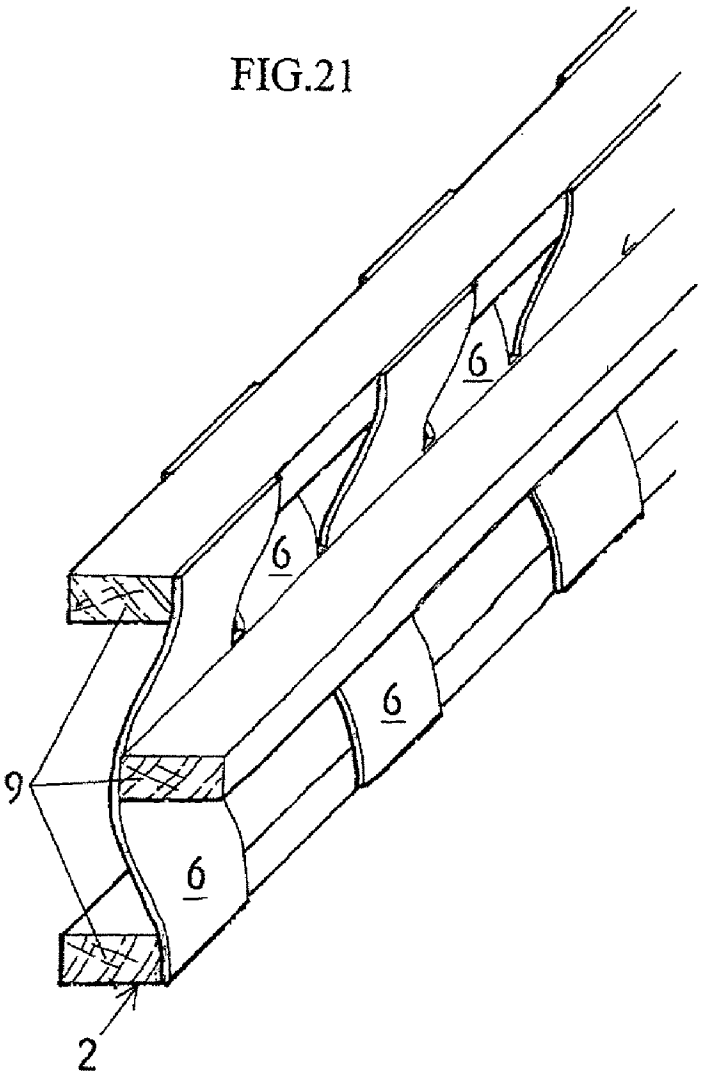

FIG. 21 shows the variant shown in FIG. 19A-D according to another embodiment.

Figure 22:
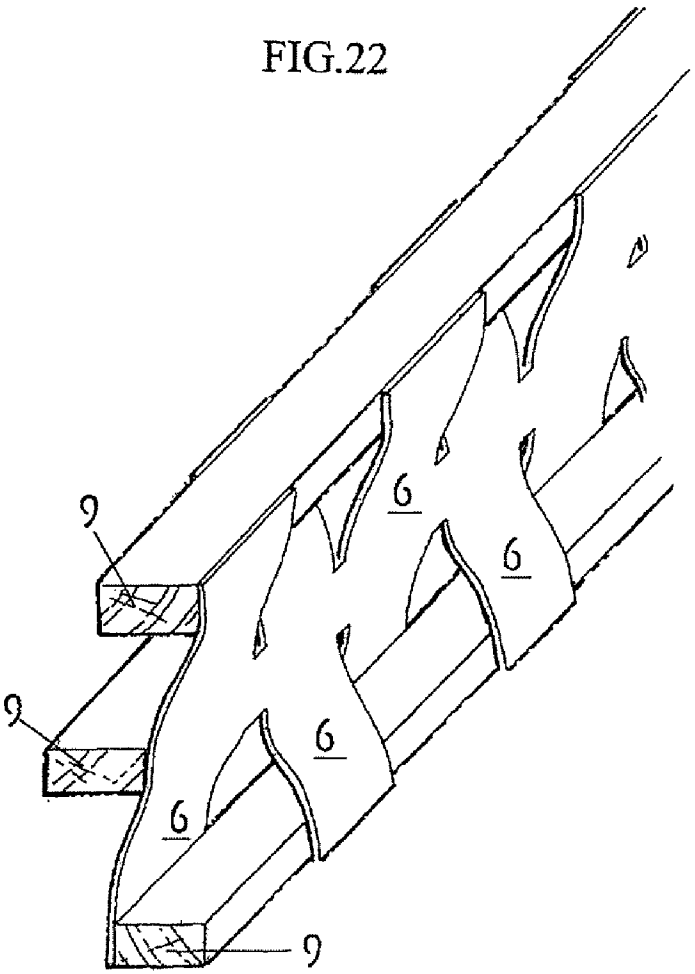

FIG. 22 shows the variant shown in FIG. 20A-D according to another embodiment.

Figure 23:
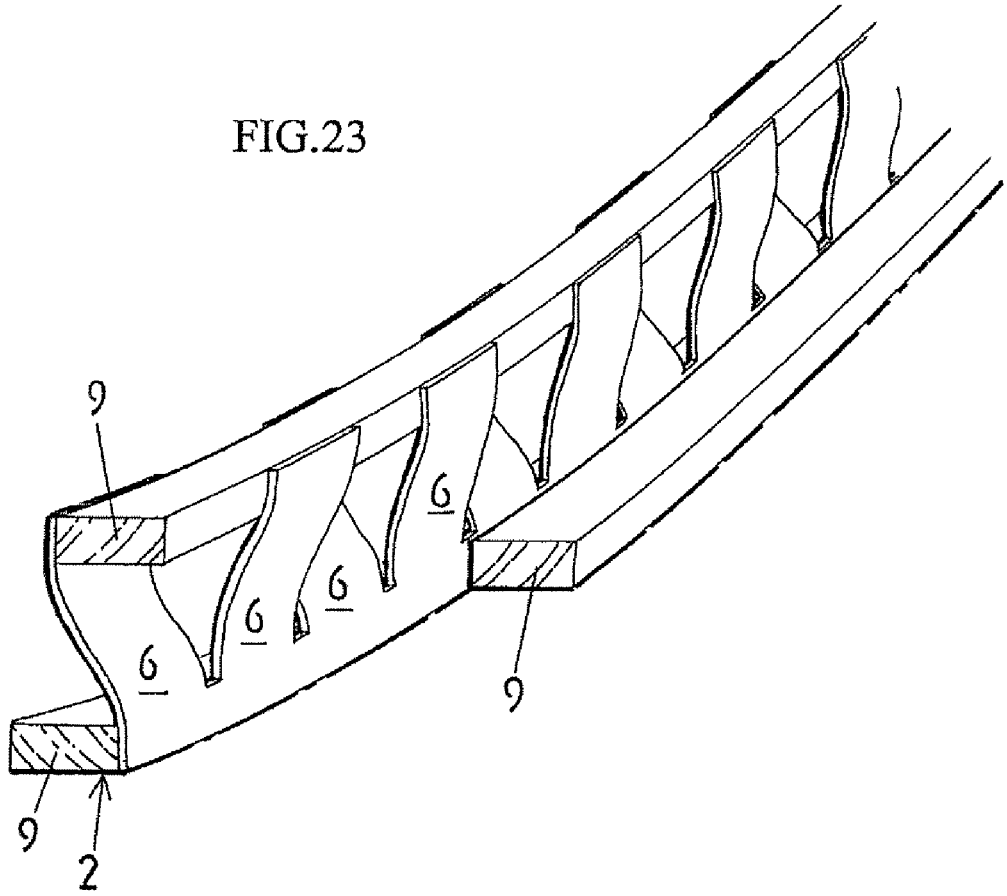
Figure 24:
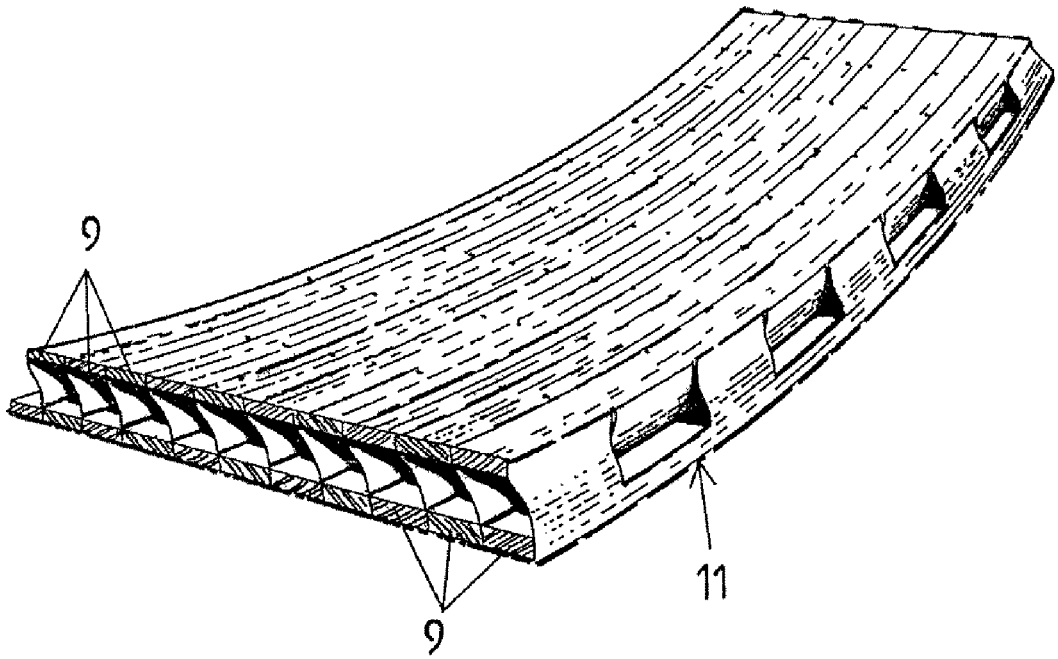

FIG. 23 shows a structural component designed in an arcuate manner in the longitudinal direction, and FIG. 24 shows a supporting member formed from such structural components.

Figures 1A, 1B, 1C, 1D, 1E:
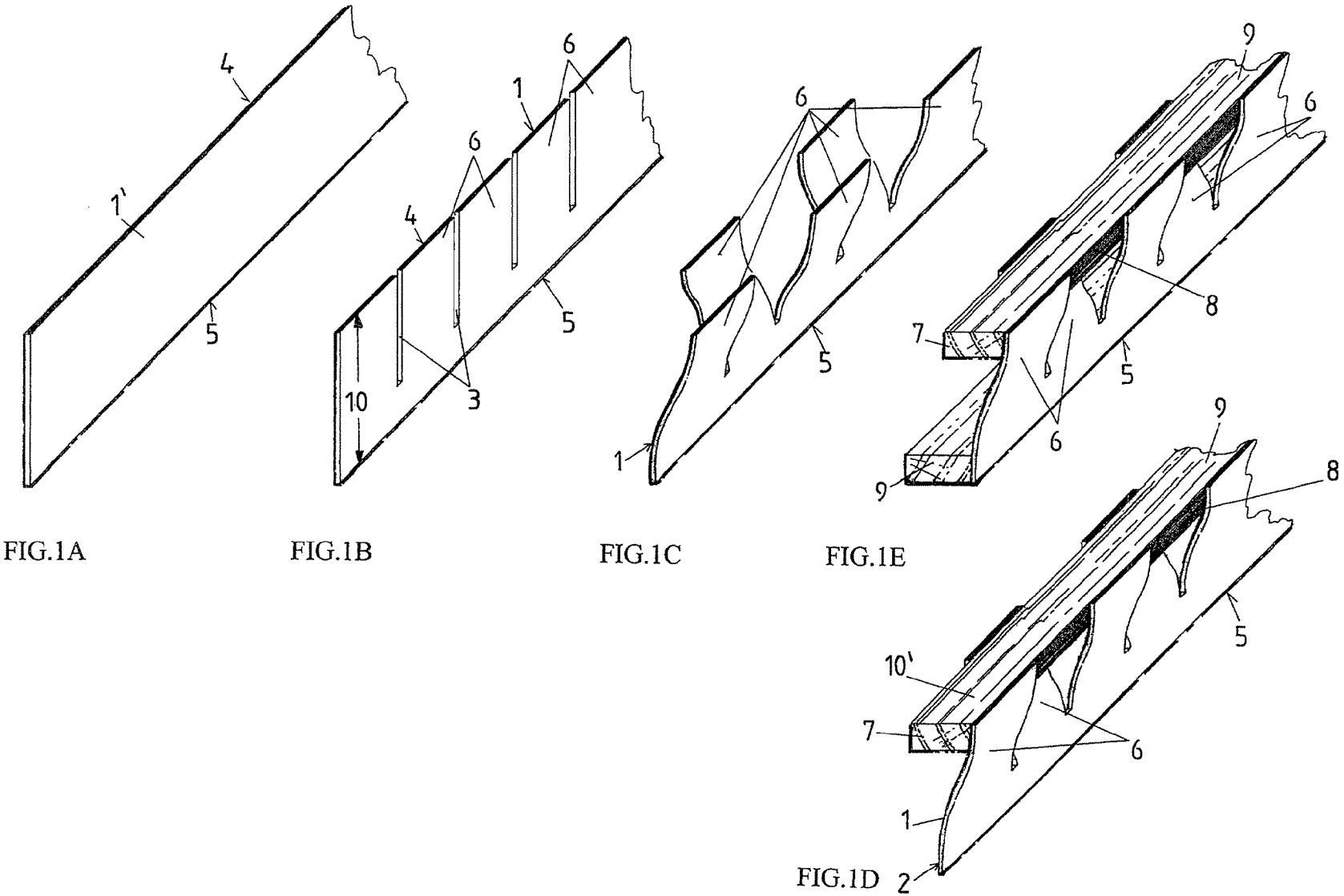

According to the embodiment illustrated in FIG. 1D, a web 1 of a structural component 2 is formed by a plate 1' (cf. FIG. 1A) which is divided into web members 6 integrally connected at the continuous longitudinal edge 5 by parallel incisions 3 (cf. FIG. 1B) which extend from a longitudinal edge 4 of the plate 1' toward the opposite longitudinal edge 5. Adjacent web members 6 are bent by right- and left-hand bending, respectively (cf. FIG. 1C), toward different narrow edges 7, 8 of a flange 9 so that one web member 6 rests against the flange 9 with one side of the web 1 and the adjacent web member 6 rests against the flange 9 with the opposite side of the web 1. The web members 6 form the shape of an "S", with the shape of the "S" being designed in a more or less stretched manner, which, however, depends on the longitudinal extension 10 of the web members 6. Since the web members 6 exhibit the same longitudinal extension 10, a symmetrical cross-section is produced. Also an asymmetrical cross-section can be achieved by different longitudinal extensions 10 of respective web members 6 adjacent to each other.

According to the variant illustrated in FIG. 1D, the free ends of the web members 6 are connected to the narrow edges 7, 8 of the flange 9 across the entire contact surface, for example, if the structural component is manufactured from wood by bonding or gluing, respectively.

The ends of the web members 6 terminate flush with the outside 10' of the flange 4, which can be achieved in a simple manner by machining the structural component 2 which has been finished, e.g., by bonding or gluing, respectively.

Figure 3:
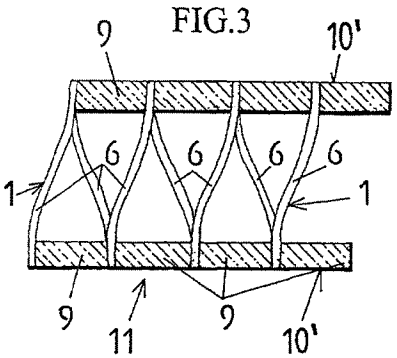
FIG. 3 depicts the cross-section of a bearing structure formed from several structural components arranged next to each other and connected to each other.

As can be seen in FIG. 1E, flanges 9 can be arranged on both sides of the web 1 in the area of the longitudinal edge 5 of the web 1 where the web members 6 are integrally connected so that it is possible to manufacture a supporting member 11 formed from two or several or a plurality of structural components 2 arranged next to each other and connected to each other, e.g., by bonding or gluing, respectively, which is shown, for example, in FIG. 3. Preferably, this is done in such a way that the web members 6 bent on the left and on the right engage the free flanks of the added structural component 2 in a zipper system, wherein, furthermore, a flange 9 opposite the flanges 9 of the structural components 2 is inserted between the free end regions of the web members 6 of the adjacent structural components 2 and is connected to the end regions of the web members 6.

Figures 2A, 2B, 2C, 2D:
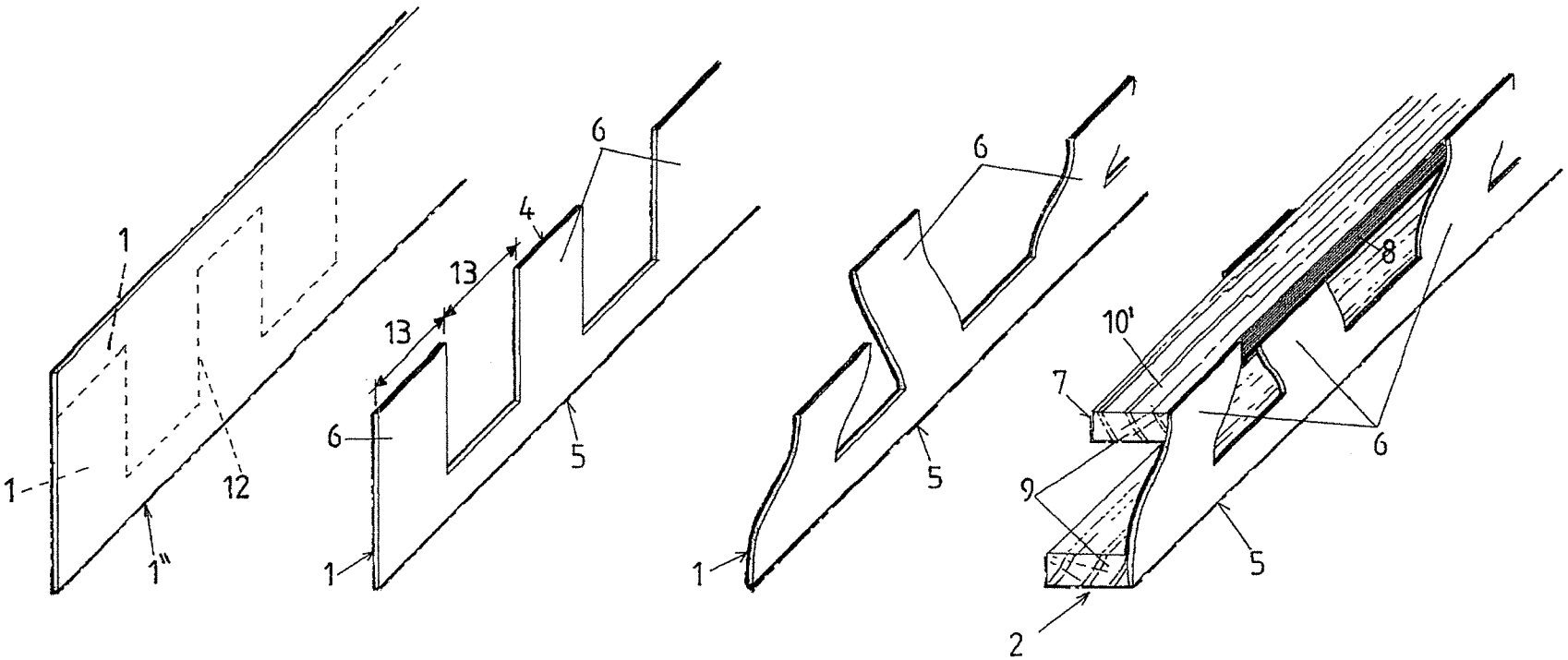
FIGS. 2A to 2D show a variant in an illustration analogous to FIGS. 1A-D.

A particularly economic material utilization for the web material is illustrated with the aid of FIGS. 2A to 2D. According to FIG. 2A, two webs 1 are punched from a plate 1", with the line of punching following line 12, which is indicated in a dashed manner. Thus, two webs 1 are produced from one plate 1", as illustrated in FIG. 2B. Adjacent web members 6 of a web 1 are thereby located at a larger distance, which, in turn, corresponds to the width 13 of a web member 6. The left- and right-hand bending for the integration of a flange 9 is designed analogously to the variant depicted in FIG. 1D.

Figure 5:
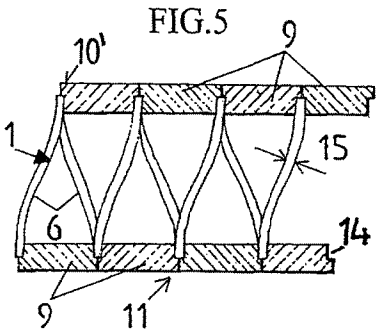
FIG. 5 depicts a supporting member formed from several structural components according to FIG. 4.
Figure 4:
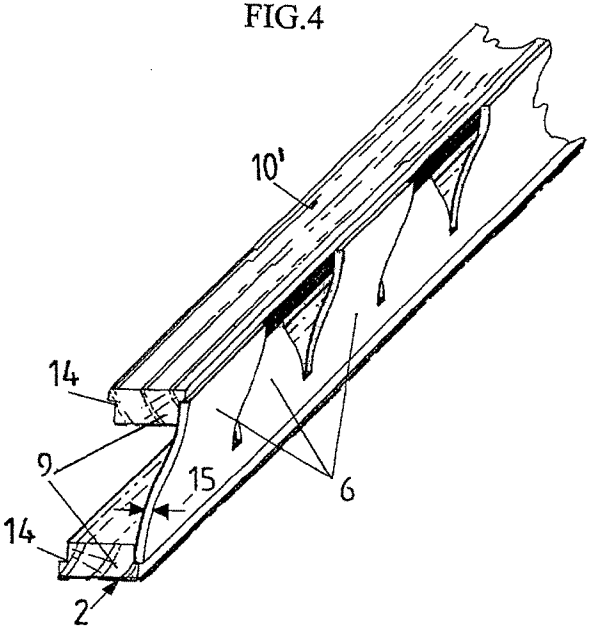
FIG. 4 shows a further variant in an illustration analogous to FIG. 1D.
Figures 8A, 8B, 8C, 8D:
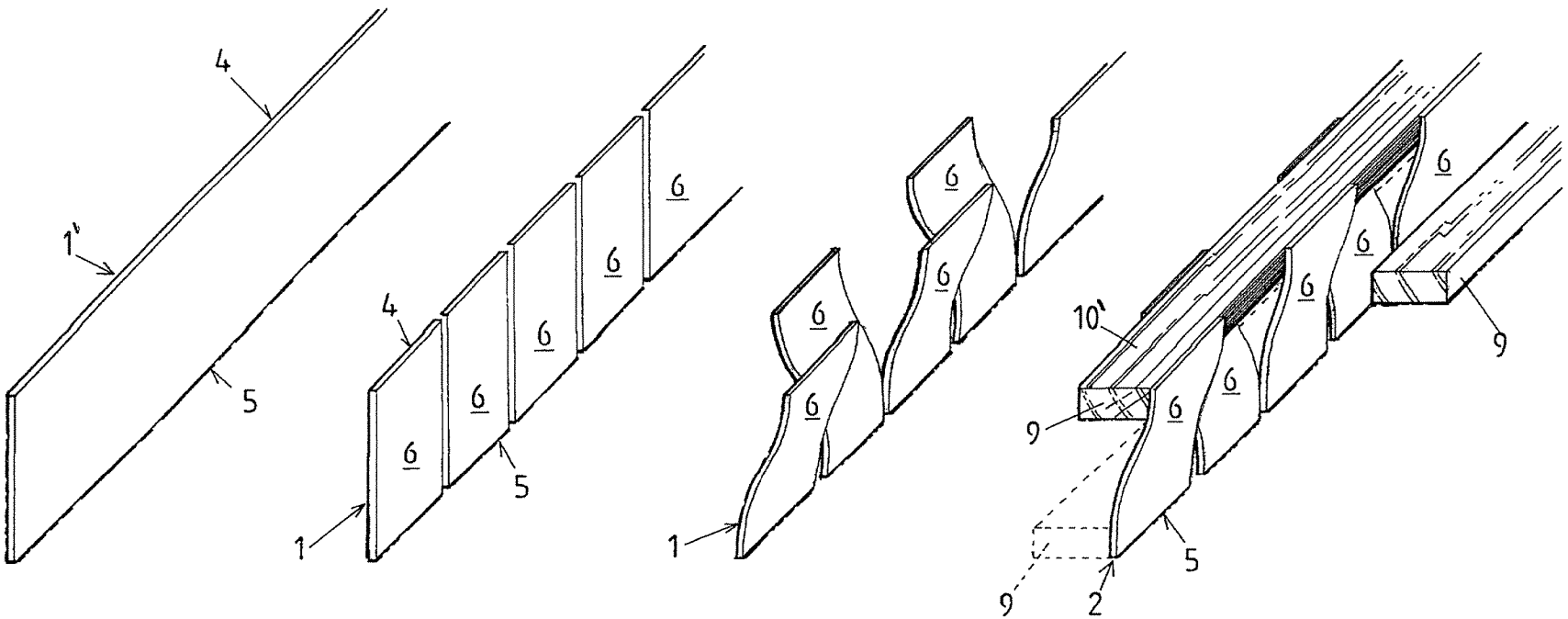

FIG. 4 illustrates an embodiment of a structural component 2 in which the web members 6 project with their free ends into a notch 14 of a flange 9 and are connected there to the flange 9. The depth of the notch 14 equals half the thickness 15 of the web members 6, the height of the notch 14 can be chosen according to the demands made on the structural component 2. FIG. 5 shows several structural components 2 designed according to FIG. 4, which are assembled into a supporting member 11.

Figure 7:
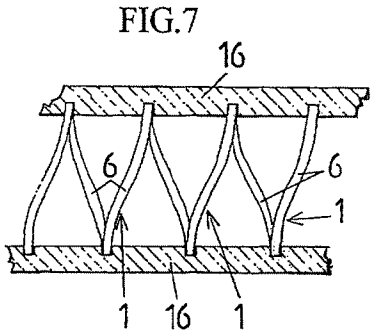
FIG. 7 shows a further variant in an illustration analogous to FIG. 5.
Figure 6:
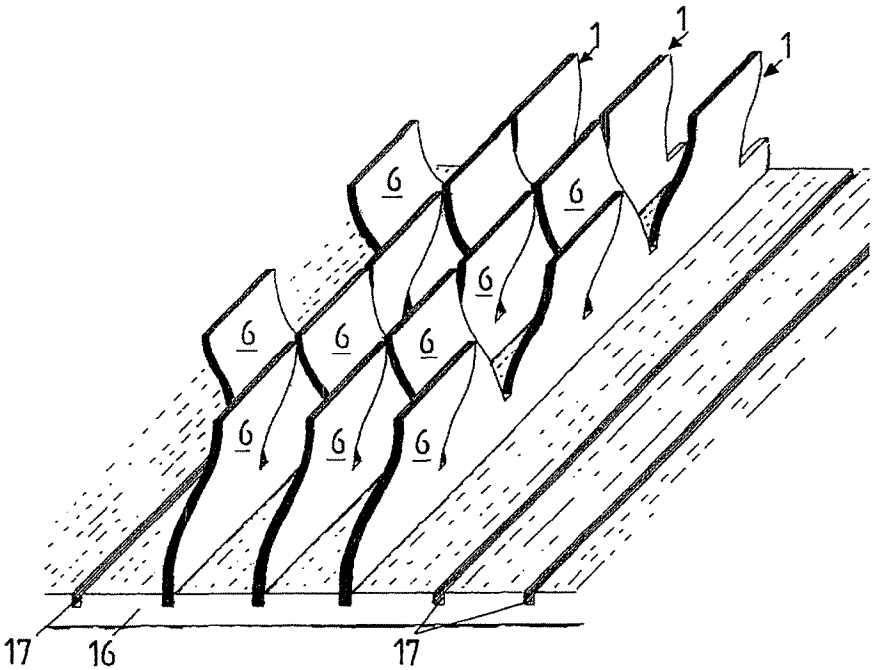
FIG. 6 shows, in an oblique view, a partial view of said variant with a roofing panel taken off.

If an individual structural component 2 is not desired but merely a supporting member 11 made up of several structural components 2 is required, it is also possible to design the flanges 9 in an integrally connected manner as a plate 16, wherein the webs 1 and the web members 6, respectively, are inserted into grooves 17 of the plate 16 and are connected to the plates 16 in those grooves 17. Such a variant is shown in FIG. 6 in an oblique view with the upper plate 16 being omitted and in FIG. 7 in profile. The groove depths conform to the thickness of the plates 16; they may account for up to a third of the thickness of the plates 16.

According to FIGS. 8A to 8D, web members 6 are formed by cutting completely through a plate 1' to form individual elements. In doing so, it is required to fasten the web members 6 to the longitudinal edge 5 of the web 1, which is formed by the adjacent web members 6, by means of a flange 9, preferably inserting them between two adjacent flanges 9, which, in turn, can of course also be achieved if the flanges 9 are integrally connected and the web members 6 project into a groove, as illustrated in FIG. 6.

Figures 9A, 9B, 9C, 9D:
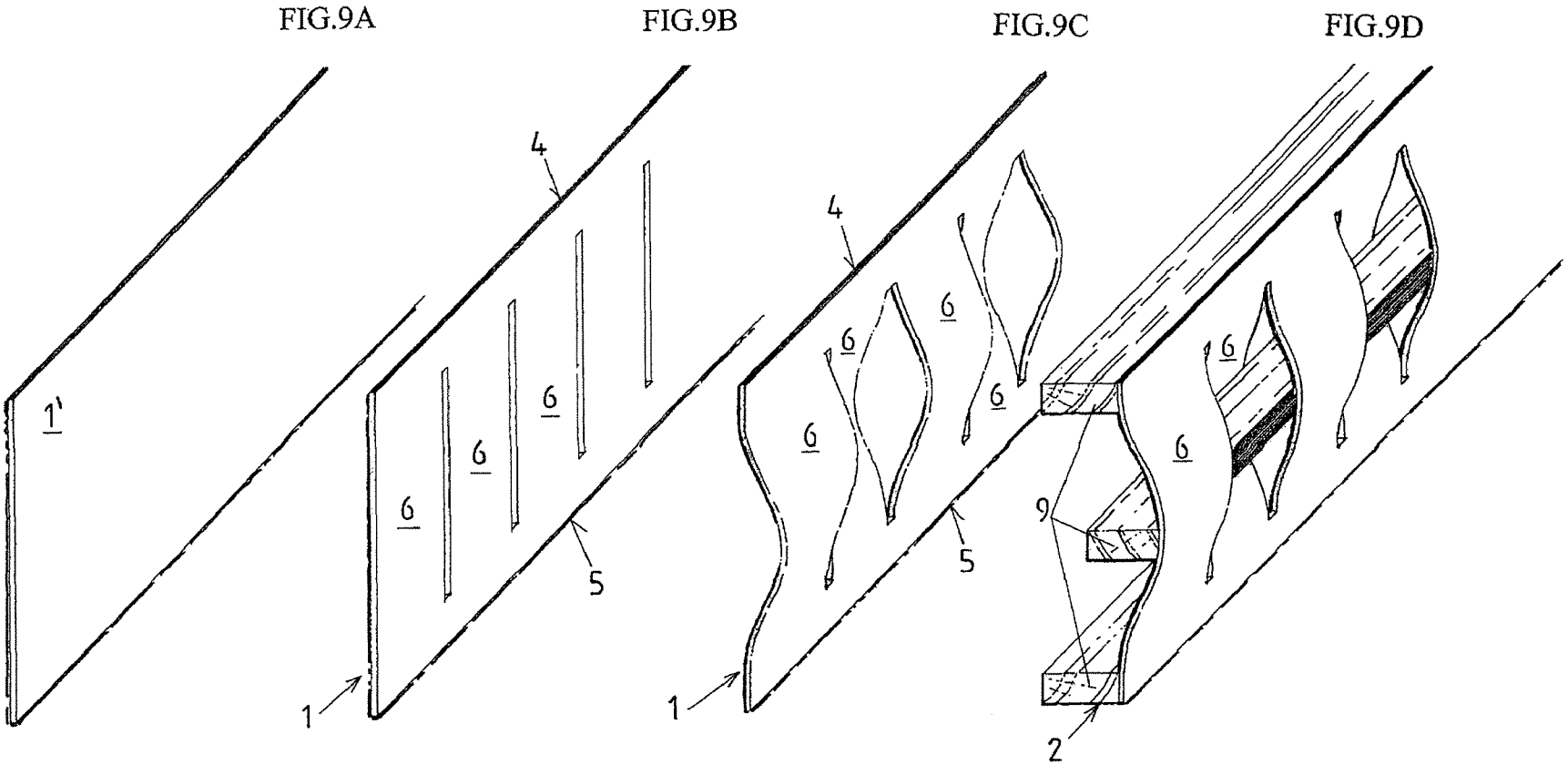
Figures 11A, 11B, 11C, 11D:
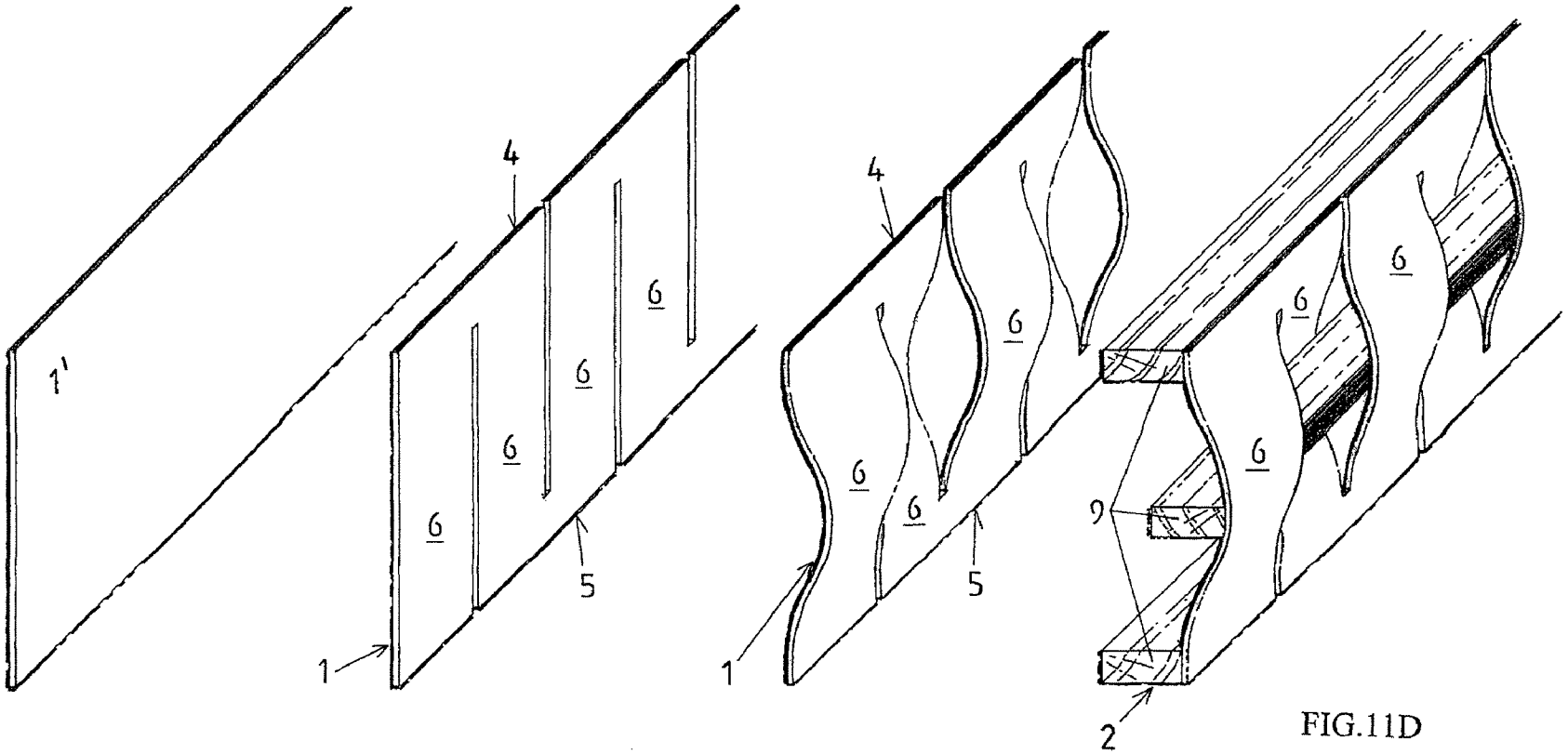
Figures 12A, 12B, 12C, 12D:
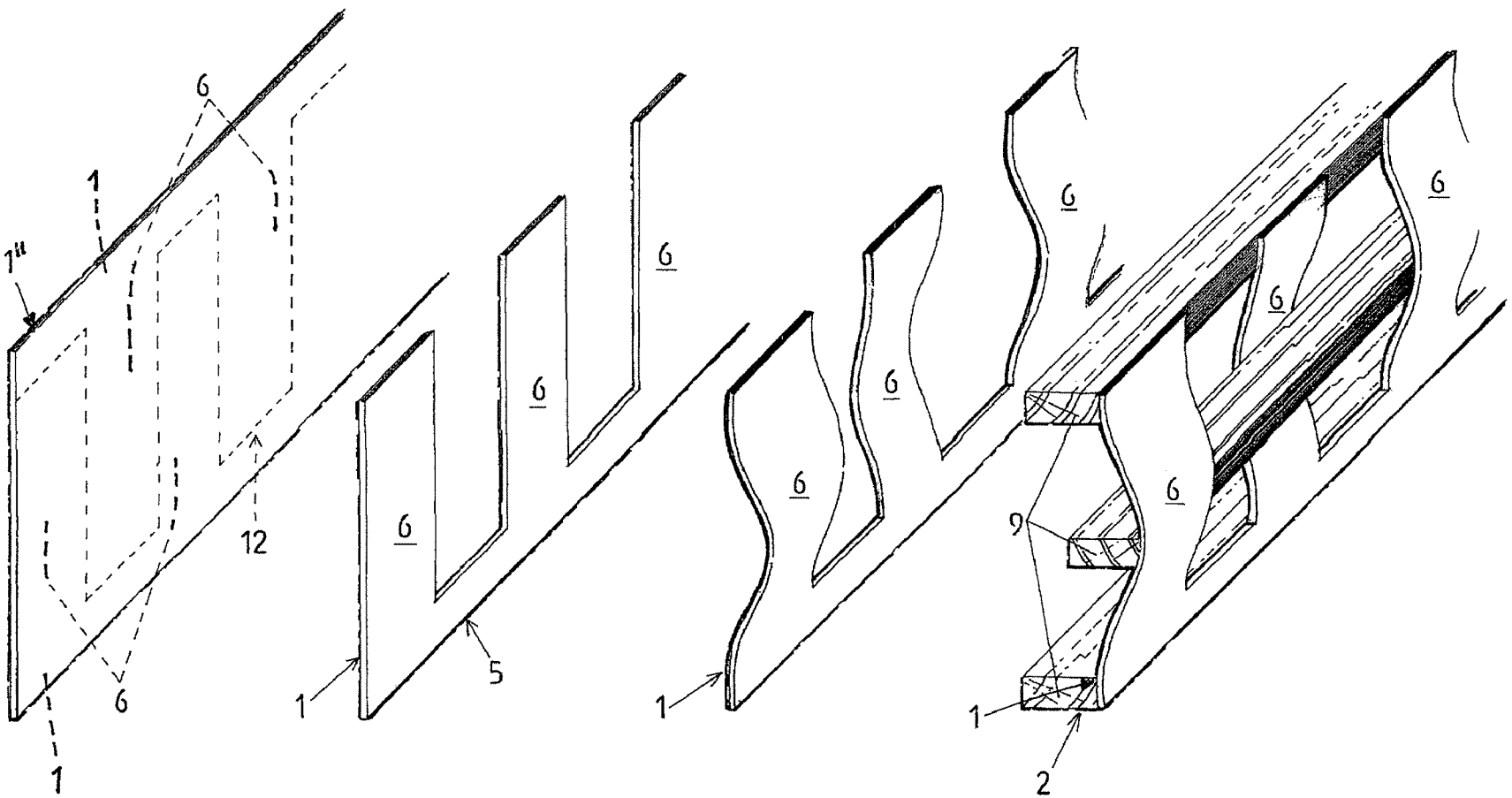
Figures 13A, 13B, 13C, 13D:
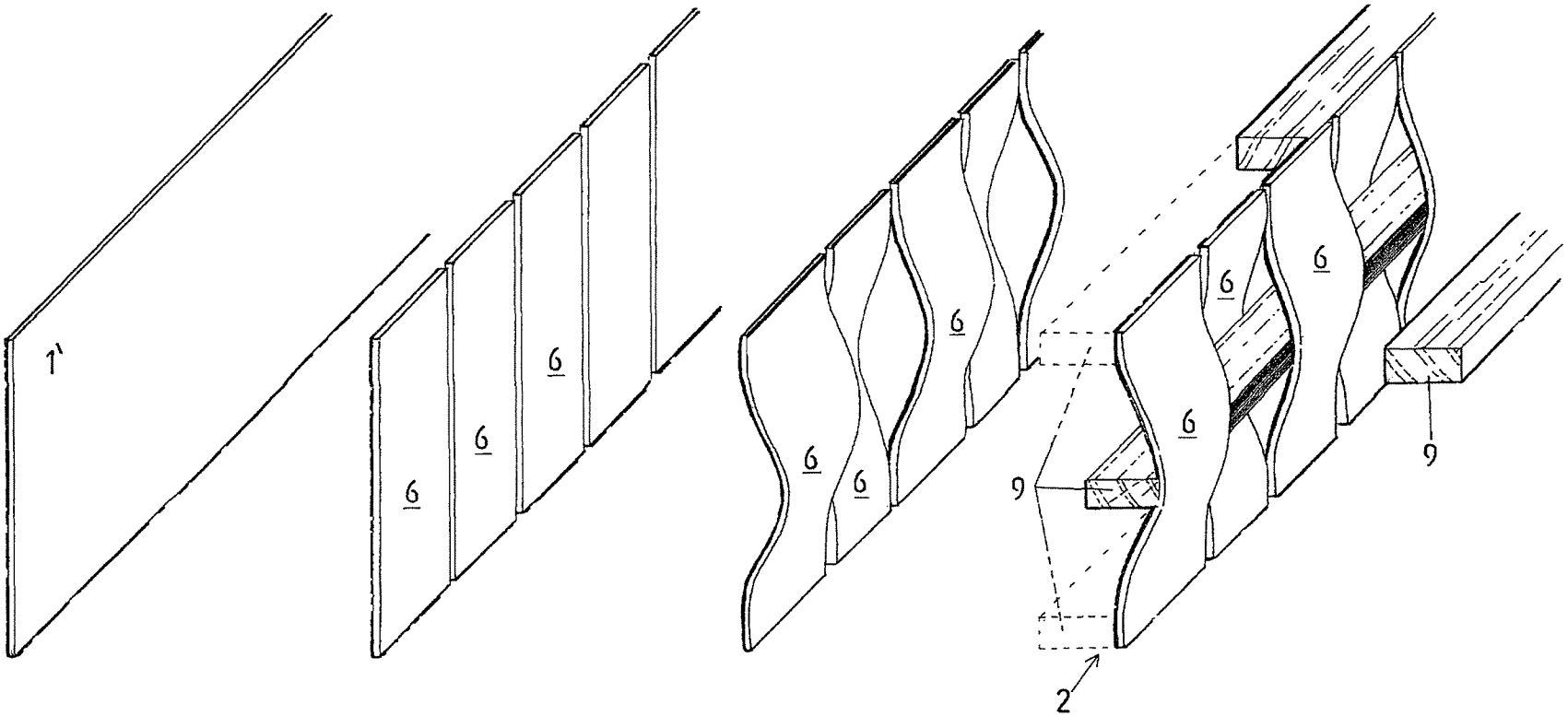

According to the embodiments illustrated in FIGS. 9A to 18, the web members 6 extend beyond a flange 9 on both sides thereof and are connected on both ends with a double "S" and a linear edge region being formed, namely either integrally, as illustrated in FIGS. 9B to 9D, or with the aid of one or two adjacent flanges 9, as shown in FIG. 13D. FIGS. 10D, 11D and 12D show hybrids, i.e., the web members 6 are connected to a flange at one longitudinal edge 4 or 5, respectively, of the web 1 and are integrally connected to each other at the opposite longitudinal edge.

According to the variant depicted in FIG. 9D, a plate 1' forming the web 1 (cf. FIG. 9A) is slotted only between the longitudinal edges 4, 5 (cf. FIG. 9B) so that the web members 6 are still integrally connected on both sides. This is then followed by left-right-bending of the sections of adjacent web members 6 which are central with regard to height and by threading a flange 9 into the space formed by the convexities of the web members 6.

Figures 10A, 10B, 10C, 10D:
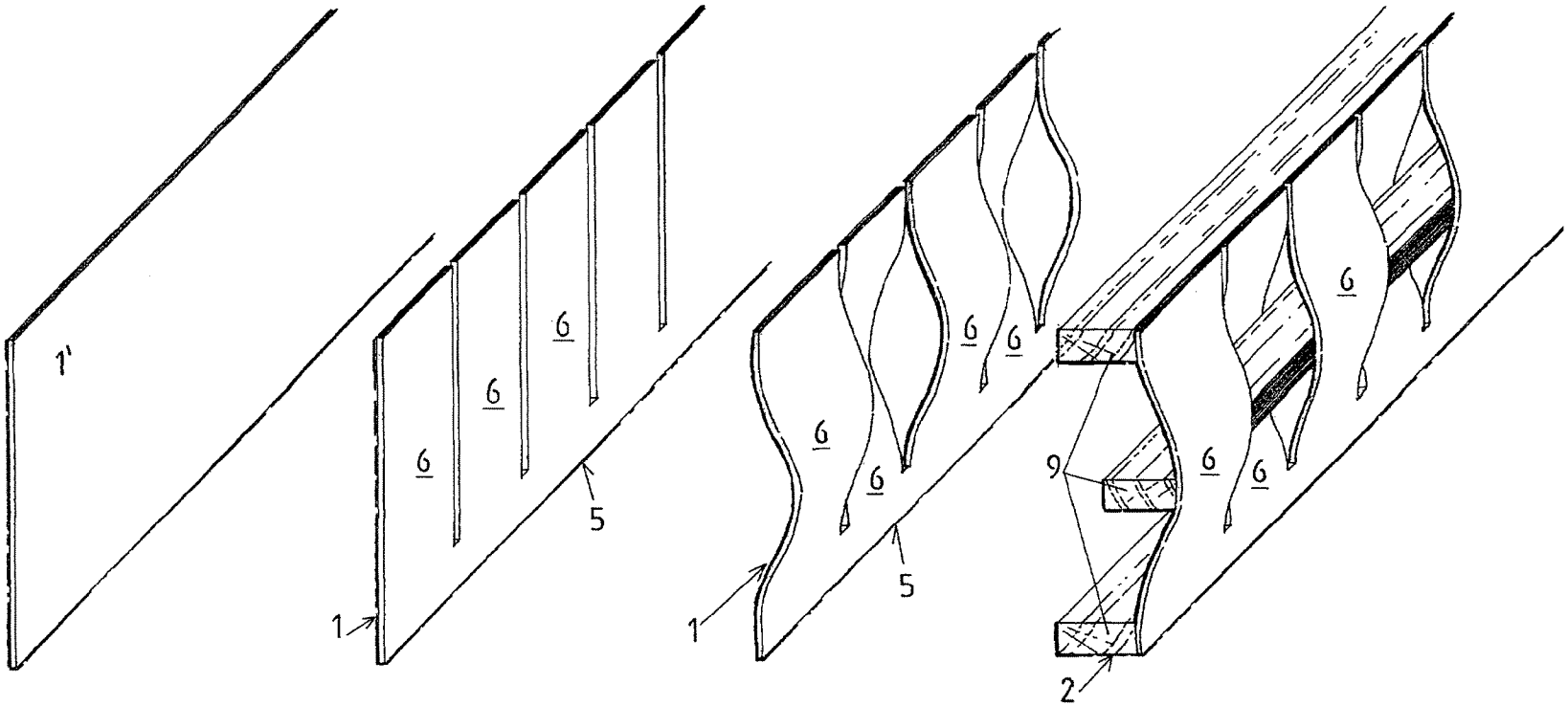

According to FIG. 10D, the web members 6 are integrally connected only at one longitudinal edge 5.

A special feature is also shown by FIG. 11B, according to which adjacent web members 6 are integrally connected once at one longitudinal edge 4 and once at the opposite longitudinal edge 5 of the web 1. Also in that case, threading of a flange 9 into the space formed by the bulges of the web members 6 is required.

FIG. 12A, in turn, shows an economic utilization of a plate 1" for the web 1 so that two webs 1 can be formed from said plate 1". This is again effected by punching along the dashed line 12 of FIG. 12A. Said variant—like the variant according to FIG. 2D—is of interest if a larger web member distance is sufficient for the load-bearing capacity of the structural component 2.

FIG. 13D, in turn, shows a structural component 2 in which the web members 6 are individual parts which are completely separate from the respective adjacent web member 6.

Figure 18:
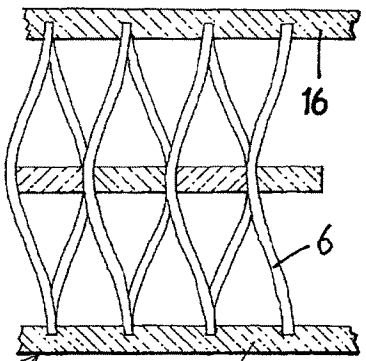

FIGS. 14 to 18 show variants of the formation of a supporting member 11 formed from two, several or a plurality of structural components 2, as shown in FIGS. 9D, 10D, 11D, 12D and 13D, wherein the ends of the web members 6 again terminate planely with flanges 9 (FIG. 14) or project into notches 14 of the flanges 9, namely of those flanges which are arranged on the outside of the supporting member 11. FIGS. 17 and 18, in turn, illustrate an integral design of the outside flanges as plates 16 of the supporting member 11, with the web members 6 again projecting into grooves 17 of those plates, analogously to the illustration of FIG. 7.

Figures 19A, 19B, 19C, 19D:
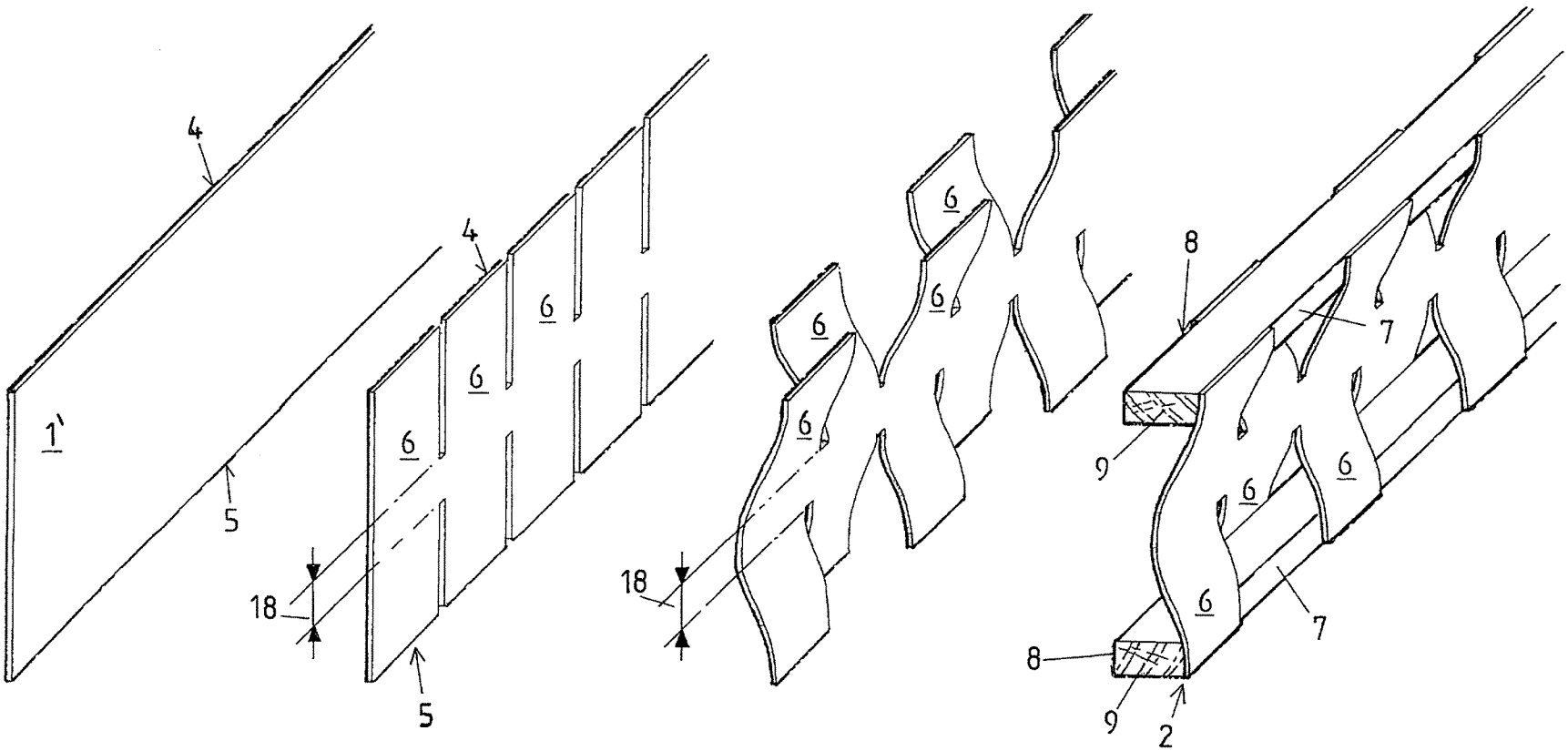
Figures 20A, 20B, 20C, 20D:
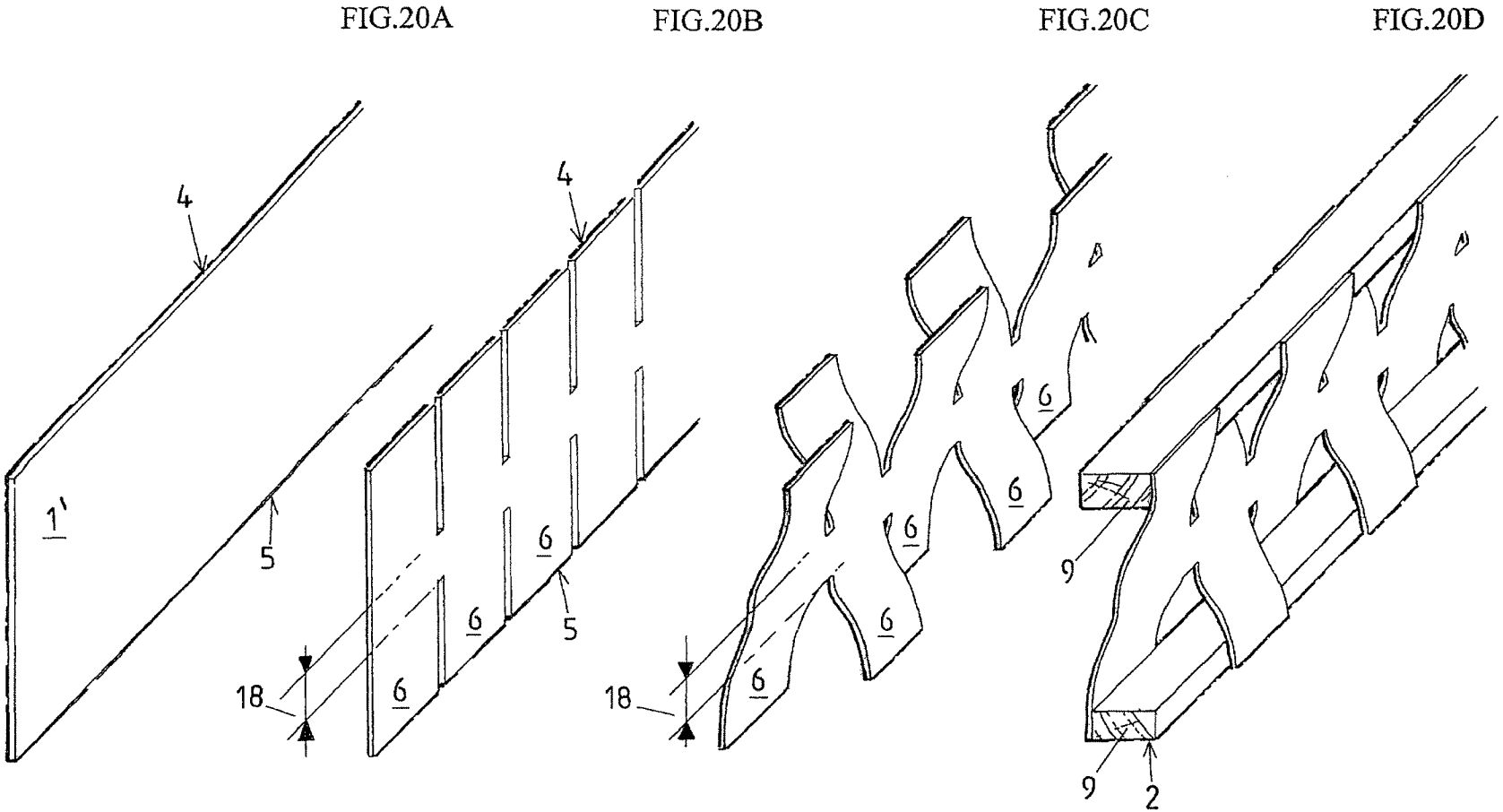

A structural component 2 of a special type is also shown in FIGS. 19D and 20D. In said structural component, the web members 6 are integrally connected at the centre of their longitudinal extension, which is accomplished by cutting into a plate 1' for the web from both longitudinal edges 4, 5 as far as to a central linear longitudinal area 18 (cf. FIGS. 19B and 20B). After folding the ends of the web members 6 on the left and on the right, two flanges 9, which are connected to the ends of the web members 6, may be inserted between the ends of the web members 6. In that case, the structural component 2 does not require a flange 9 which is central with regard to height.

According to FIG. 19D, the two ends of a web member 6 are, in each case, bent toward the same flange side 7 or 8, respectively, according to the variant illustrated in FIG. 20D, they are, in each case, bent toward different sides 7 or 8, respectively, of the flange 9.

The structural components 2 according to FIGS. 19D and 20D may again be assembled—as described before according to the zipper type—by arranging them next to each other and connecting them to form a plate-shaped supporting member 11.

With such a plate-shaped supporting member 11, a flange 9 which is central with regard to height can of course also be used to provide a particular reinforcement, as illustrated in FIGS. 21 and 22. Said flange will then rest against the web members 6 at the height of the integrally connected areas 18 thereof and will also be connected to the web members 6 in those areas, again by bonding or gluing.

The invention is not only restricted to linear structural components; rather, those components may also be designed in an arcuate manner, which is illustrated in FIG. 23. In that case, the arc shape is predetermined by the arc shape of the flange 9 or of the flanges 9, respectively. By arranging such arcuate structural components next to one another, arcuate plane-shaped supporting members 11 may also be formed (cf. FIG. 24).

In order to achieve a high load-bearing capacity with, at the same time, good torsional capacity, the ratio of the width of the flange to the height of the structural component 2 ranges between 1:20 and 1:1, preferably from 1:6 to 1:1, in particular from 1:3.5 to 1:2.5.

The structural component 2 is preferably formed entirely from wood, with the flange 9 preferably being manufactured from plywood and the web 1 suitably being formed from a three-layered plywood or a five-layered plywood and the wood fibres of the outer layers of the plywood extending in the longitudinal direction of the structural component 2. Constructions of this kind provide a particularly good ratio between the dead weight and the load-bearing capacity. In addition, low-grade sawn timber from the sawmill industry can be used for the flange 9, resulting in an increase in the added value of said timber.

If the structural component 2 is joined together by an adhesive material, glues, in particular synthetic resin glues and PU-glues, are preferably used as adhesive materials for wood. Modern adhesives which are microwave or UV-curing offer further possibilities. It is likewise possible to use a film glue instead of a liquid glue.

Preferably, the continuous cavity formed by the web 1 and the flange 9 is filled with a material such as, for example, silica sand, cellulose flakes, PU-foam, pearlites, etc.

The filling leads to various solutions for all kinds of problems, such as, e.g., for satisfying thermic and acoustic demands. As desired, the filling can occur prior to or after the installation of the structural component, the latter involving the advantage of easier manipulation, particularly since in that case only the lightweight hollow structural components 2 have to be transported.

A structural component 2 with a symmetrical cross-section characterized in that the end region of the web 1 lies in the centre of the width of the flange 9 is advantageous in terms of stress.

A further preferred use of a structural component 2 according to the invention becomes evident after assembling several of the structural components to form sheet materials which may serve as wall elements and wall coverings, respectively. The sheet materials can also be used as formwork elements for concrete construction and as moulding elements for large trusses, silos, etc.

The structural component 2 according to the invention has the advantage that, in principle, it can be formed from all kinds of materials on the whole and also from various materials for the flange 9 and the web 1, respectively, wherein, for the web 1, predominantly materials are considered which are able to absorb shearing forces and, in addition, are flexible and preferably glueable. The web 1 can, for example, be made of cardboard, plastic, sheet metal, multi-layered plywood or other wood materials. It is likewise possible to make the flange 9 from various materials such as plastic, cardboard, multi-layered plywood or also from metal.

The invention claimed is:

1. A beam-like structural component made up of individual parts connected to each other, comprising at least one flange and at least one web, wherein the web is formed of a single plate and is made up of web members, wherein web members form a linear longitudinal area extending across the length of the web, and wherein the web members extend transversely to the extension of the linear longitudinal area and, in each case, two adjacent web members extend toward different narrow edges of the flange starting from the longitudinal area of the web so that one web member rests against the flange with one side of the web and the adjacent web member rests against the flange with the opposite side of the web, wherein the web members exhibit the shape of an "S" and that a continuous cavity extending longitudinally is formed between the linear longitudinal area and the at least one flange and wherein ends of the web, which extend along a longitudinal narrow edge of the flange, terminate flush with at least a portion of an outside of the flange.

2. A structural component according to claim 1, wherein the web members are formed with one end of a linear longitudinal edge extending across the length of the web, from which adjacent web members extend toward different narrow edge regions of the flange.

3. A structural component according to claim 1, wherein the web is formed by integrally connected web members, wherein in each case, two adjacent web members are integrally connected to each other on at least one longitudinal area, in particular on one of the longitudinal edges.

4. A structural component according to claim 1, wherein the ends of the web members project into a notch formed in the flange parallel to the length of the beam-like structural component and are connected there to the flange.

5. A structural component according to claim 4, wherein the notch exhibits an extension which is transverse to the longitudinal edge of the web members and is of a size that equals half the thickness of the web members at the longitudinal edge thereof.

6. A structural component according to claim 1, wherein the web members are arranged directly adjacent to each other and are separated from each other by a maximum distance on the order of the width of a saw kerf.

7. A structural component according to claim 1, wherein adjacent web members are provided at a distance corresponding to at least the width of a web member.

8. A structural component according to claim 1, wherein the ends of the web which extend along the longitudinal sidewall of the flange terminate flush with at least a portion of the outside of the flange as a result of machining which is performed on a supporting member made up of several structural components.

9. A structural component according to claim 1, wherein the ratio of the width of a flange to the height of the web ranges between 1:20 and 1:1.

10. A structural component according to claim 1, wherein it is formed from wood, with the flange preferably being manufactured from sawn timber and the web preferably being manufactured from plywood.

11. A structural member according to claim 10, wherein the web is formed from a plywood having at least three layers of wood, with the wood fibres of the outside of the plywood extending in the longitudinal direction of the structural component.

12. A structural component according to claim 1, wherein an adhesive material is used for connecting the individual parts.

13. A structural component according to claim 1, wherein the cavity defined by the web and the flange is filled with material selected from the group consisting of silica sand, cellulose flakes, pearlites, and PU-foam.

14. A structural component according to claim 1, wherein the web members extend beyond the flange on both sides thereof and are interconnected on both ends with a double-S and a linear longitudinal edge being formed.

15. A structural component according to claim 14, wherein the longitudinal edges of the web which project beyond the flange are formed integrally.

16. A structural component according to claim 14, wherein the flange is arranged on a central plane of symmetry of the structural component.

17. A structural component according to claim 14, wherein a further flange is provided on at least one longitudinal edge of the web.

18. A structural component according to claim 14, wherein adjacent web members are formed by cutting into a plate alternately, namely once from a longitudinal edge region and once from the opposite longitudinal edge region, wherein the end regions of the web members, which project beyond the flange, are in each case connected to each other by means of a further flange.

19. A structural component according to claim 1, wherein the web members are designed so as to be integrally connected in an area located between their ends with regard to their lengths and wherein the parts of the web members which extend away from said area toward one side and toward the other side in each case extend toward the flange in a manner bent in the same direction or in an opposite direction.

20. A structural component according to claim 1, wherein the ratio of the width of a flange to the height of the web ranges between 1:6 to 1:1.

21. A structural component according to claim 1, wherein the ratio of the width of a flange to the height of the web ranges between 1:3.5 to 1:2.5.

22. A supporting member formed from two or several structural components according to claim 1, wherein structural components are arranged next to each and are connected to each other with the flanges being arranged in one plane.

23. A supporting member according to claim 22, wherein flanges lying an one surface, in particular one plane, are formed integrally with a plate being formed, wherein the end regions of the web members are inserted into grooves incorporated into the plate.

* * * * *